US006550214B2

(12) United States Patent
Aguilera

(10) Patent No.: US 6,550,214 B2
(45) Date of Patent: Apr. 22, 2003

(54) CONCRETE SMOOTHING DEVICE

(76) Inventor: Gilbert Aguilera, 419 S. Victoria Ave., Corona, CA (US) 91720

( * ) Notice: Subject to any disclaimer, the term of this patent is extended or adjusted under 35 U.S.C. 154(b) by 0 days.

(21) Appl. No.: 09/844,607

(22) Filed: Apr. 27, 2001

(65) Prior Publication Data

US 2002/0157203 A1 Oct. 31, 2002

(51) Int. Cl.[7] ..... E04F 21/24

(52) U.S. Cl. ..... 52/749.13; 52/749.1; 15/144.1; 15/235.4; 404/97; 404/118

(58) Field of Search ..... 404/97, 114, 118, 404/119, 120, 103; 52/749.1, 749.13; 15/235.4, 235.8, 144.1

(56) References Cited

U.S. PATENT DOCUMENTS 3,729,765 A * 5/1973 Peterson ..... 15/235.8
4,591,291 A * 5/1986 Owens ..... 404/118
4,856,932 A * 8/1989 Kraft ..... 404/118
4,892,437 A * 1/1990 Kraft ..... 404/97
5,375,942 A * 12/1994 Lindley et al. ..... 404/97
5,467,496 A * 11/1995 Jarvis ..... 15/235.8
5,540,519 A * 7/1996 Weber ..... 404/102
5,687,448 A * 11/1997 Dye, Jr. ..... 15/235.8
5,737,795 A * 4/1998 Murders ..... 15/235.4
6,139,217 A * 10/2000 Reuter ..... 404/97
6,200,065 B1 * 3/2001 Eitzen ..... 404/114
6,231,331 B1 * 5/2001 Lievers ..... 425/183

* cited by examiner

*Primary Examiner*—Carl D. Friedman
*Assistant Examiner*—Yvonne M. Horton
(74) *Attorney, Agent, or Firm*—Goldstein & Lavas, P.C.

(57) ABSTRACT

A concrete smoothing device including a plate portion having an upper surface and a lower surface. The lower surface is planar for positioning on freshly poured concrete. The upper surface has a reinforcement brace secured centrally thereon. A swivel bracket is secured to the reinforcement brace of the upper surface of the plate portion. The swivel bracket includes a cylindrical post extending upwardly from the reinforcement brace. The cylindrical post has a collar rotatably disposed thereon. The collar has a pair of arms extending laterally therefrom. The pair of arms has a space disposed therebetween. An elongated handle is provided having an upper end and a lower end. The lower end has an end cap secured thereto. The end cap has a tab extending outwardly therefrom. The tab is positioned within the space between the pair of arms of the swivel bracket and pivotally secured thereto by a pivot pin.

2 Claims, 2 Drawing Sheets

CONCRETE SMOOTHING DEVICE

BACKGROUND OF THE INVENTION

The present invention relates to a concrete smoothing device and more particularly pertains to allowing freshly poured concrete to be smoothed from an upright position.

The use of tools for working with concrete is known in the prior art. More specifically, tools for working with concrete heretofore devised and utilized for the purpose of smoothing concrete are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,737,795 to Murders discloses a bull float device comprised of a blade portion and a stiffener, to fill in low spots and lower high spots in recently poured concrete. U.S. Pat. No. 5,467,496 to Jarvis discloses a bull float assembly capable of being secured to an elongated handle. U.S. Pat. No. 3,936,210 to Oehlerking discloses a concrete float tool with a detachable accessory.

While these devices fulfill their respective, particular objective and requirements, the aforementioned patents do not describe a concrete smoothing device for allowing freshly poured concrete to be smoothed from an upright position.

In this respect, the concrete smoothing device according to the present invention substantially departs from the conventional concepts and designs of the prior art, and in doing so provides an apparatus primarily developed for the purpose of allowing freshly poured concrete to be smoothed from an upright position.

Therefore, it can be appreciated that there exists a continuing need for a new and improved concrete smoothing device which can be used for allowing freshly poured concrete to be smoothed from an upright position. In this regard, the present invention substantially fulfills this need.

SUMMARY OF THE INVENTION

In the view of the foregoing disadvantages inherent in the known types of tools for working with concrete now present in the prior art, the present invention provides an improved concrete smoothing device. As such, the general purpose of the present invention, which will be described subsequently in greater detail, is to provide a new and improved concrete smoothing device which has all the advantages of the prior art and none of the disadvantages.

To attain this, the present invention essentially comprises a plate portion having an upper surface and a lower surface. The lower surface is planar for positioning on freshly poured concrete. The upper surface has a plurality of tiers. The plurality of tiers includes a lower tier, a middle tier and an upper tier. The upper tier has a reinforcement brace secured centrally thereon. A swivel bracket is secured to the reinforcement brace of the upper tier of the plate portion. The swivel bracket includes a cylindrical post extending upwardly from the reinforcement brace. The cylindrical post has a collar rotatably disposed thereon. The collar has a pair of arms extending laterally therefrom. The pair of arms has a space disposed therebetween. An elongated handle is provided having an upper end and a lower end. The lower end has an end cap secured thereto. The end cap has a tab extending outwardly therefrom. The tab is positioned within the space between the pair of arms of the swivel bracket and pivotally secured thereto by a pivot pin.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved concrete smoothing device which has all the advantages of the prior art tools for working with concrete and none of the disadvantages.

It is another object of the present invention to provide a new and improved concrete smoothing device which may be easily and efficiently manufactured and marketed.

It is a further object of the present invention to provide a new and improved concrete smoothing device which is of durable and reliable construction.

An even further object of the present invention is to provide a new and improved concrete smoothing device which is susceptible of a low cost of manufacture with regard to both materials and labor, and which accordingly is then susceptible of low prices of sale to the consuming public, thereby making such a concrete smoothing device economically available to the buying public.

Even still another object of the present invention is to provide a new and improved concrete smoothing device for allowing freshly poured concrete to be smoothed from an upright position.

Lastly, it is an object of the present invention to provide a new and improved concrete smoothing device including a plate portion having an upper surface and a lower surface. The lower surface is planar for positioning on freshly poured concrete. The upper surface has a reinforcement brace secured centrally thereon. A swivel bracket is secured to the reinforcement brace of the upper surface of the plate portion. The swivel bracket includes a cylindrical post extending upwardly from the reinforcement brace. The cylindrical post has a collar rotatably disposed thereon. The collar has a pair of arms extending laterally therefrom. The pair of arms has a space disposed therebetween. An elongated handle is provided having an upper end and a lower end. The lower end has an end cap secured thereto. The end cap has a tab extending outwardly therefrom. The tab is positioned within the space between the pair of arms of the swivel bracket and pivotally secured thereto by a pivot pin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
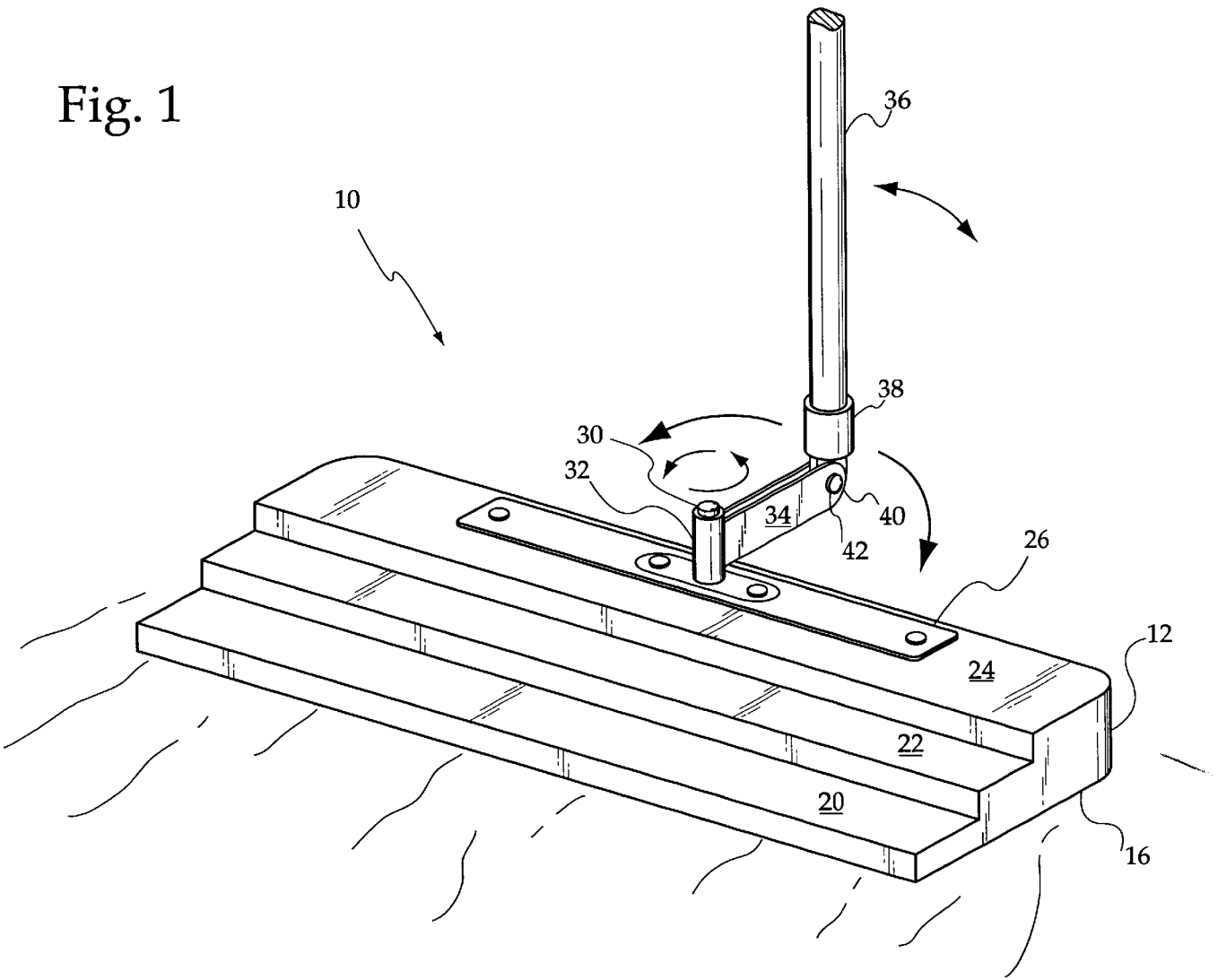
FIG. 1 is a perspective view of the preferred embodiment of the concrete smoothing device constructed in accordance with the principles of the present invention.
Figure 2:
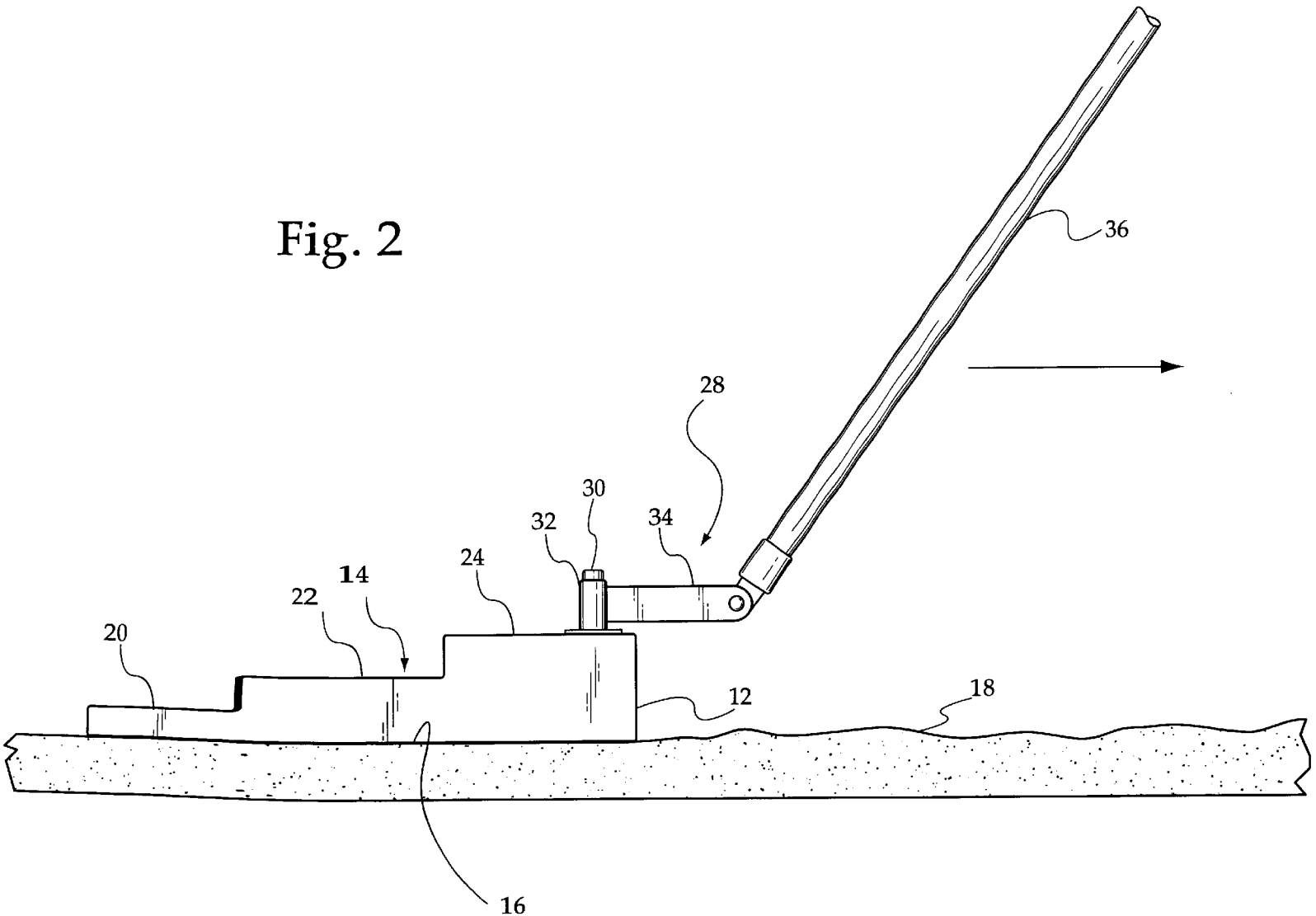
FIG. 2 is a side view of the present invention illustrated in use.

With reference now to the drawings, and in particular, to FIGS. 1 through two thereof, the preferred embodiment of the new and improved concrete smoothing device embodying the principles and concepts of the present invention and generally designated by the reference number 10 will be described.

Specifically, it will be noted in the various Figures that the device relates to a concrete smoothing device for allowing freshly poured concrete to be smoothed from an upright position. In its broadest context, the device consists of a plate portion, a swivel bracket, and an elongated handle. Such components are individually configured and correlated with respect to each other so as to attain the desired objective.

The plate portion 12 has an upper surface 14 and a lower surface 16. The lower surface 16 is planar for positioning on freshly poured concrete 18. Note figures one and two. The upper surface 14 has a plurality of tiers. The plurality of tiers includes a lower tier 20, a middle tier 22 and an upper tier 24. The upper tier 24 has a reinforcement brace 26 secured centrally thereon.

The swivel bracket 28 is secured to the reinforcement brace 26 of the upper tier 24 of the plate portion 12. The swivel bracket 28 includes a cylindrical post 30 extending upwardly from the reinforcement brace 26. The cylindrical post 30 has a collar 32 rotatably disposed thereon. The collar 32 has a pair of arms 34 extending laterally therefrom. The pair of arms 34 has a space disposed therebetween.

The elongated handle 36 has an upper end and a lower end. The lower end has an end cap 38 secured thereto. The end cap 38 has a tab 40 extending outwardly therefrom. The tab 40 is positioned within the space between the pair of arms 34 of the swivel bracket 28 and pivotally secured thereto by a pivot pin 42.

In use, the plate portion 12 can be positioned atop the newly poured concrete 18 in a manner similar to that of a float. The swivel bracket 28 allows the user to control the movement of the plate portion 12 through the use of the elongated handle 36. The elongated handle 36 allows the user to smooth the poured concrete 18 in a standing position thereby eliminating back pain and the need for additional laborers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A concrete smoothing device for allowing freshly poured concrete to be smoothed from an upright position comprising, in combination:

a plate portion having an upper surface and a lower surface, the lower surface being planar for positioning on freshly poured concrete, the upper surface having a plurality of tiers, the plurality of tiers including a lower tier, a middle tier and an upper tier, the upper tier having a reinforcement brace secured centrally thereon;

a swivel bracket secured to the reinforcement brace of the upper tier of the plate portion, the swivel bracket including a cylindrical post extending upwardly from the reinforcement brace, the cylindrical post having a collar rotatably disposed thereon, the collar having a pair of arms extending laterally therefrom, the pair of arms having a space disposed therebetween; and an elongated handle having an upper end and a lower end, the lower end having an end cap secured thereto, the end cap having a tab extending outwardly therefrom, the tab being positioned within the space between the pair of arms of the swivel bracket and pivotally secured thereto by a pivot pin.

2. A concrete smoothing device for allowing freshly poured concrete to be smoothed from an upright position comprising, in combination:

a plate portion having an upper surface and a lower surface, the upper surface having a reinforcement brace secured centrally thereon;

a swivel bracket secured to the reinforcement brace of the upper surface of the plate portion, the swivel bracket including a cylindrical post extending upwardly from the reinforcement brace, the cylindrical post having a collar rotatably disposed thereon, the collar having a pair of arms extending laterally therefrom, the pair of arms having a space disposed therebetween; and an elongated handle having an upper end and a lower end, the lower end having an end cap secured thereto, the end cap having a tab extending outwardly therefrom, the tab being positioned within the space between the pair of arms of the swivel bracket and pivotally secured thereto by a pivot pin.

* * * * *